US005410877A

United States Patent [19]

Shimada et al.

[11] Patent Number: 5,410,877

[45] Date of Patent: May 2, 1995

[54] MANIFOLD CONVERTER

[75] Inventors: Yuji Shimada; Yoichi Takahashi; Koji Noda, all of Tokyo, Japan

[73] Assignee: Calsonic Corporation, Tokyo, Japan

[21] Appl. No.: 120,072

[22] Filed: Sep. 13, 1993

[30] Foreign Application Priority Data

Sep. 21, 1992 [JP] Japan ..... 4-065653 U

[51] Int. Cl.[6] ..... F01N 3/15

[52] U.S. Cl. ..... 60/302; 60/322; 60/323; 181/207

[58] Field of Search ..... 60/322, 323, 302; 181/207

[56] References Cited

U.S. PATENT DOCUMENTS

| | | | |
|---|---|---|---|
| 1,063,385 | 6/1913 | Reed | 181/207 |
| 2,451,285 | 10/1948 | Heath | 60/322 |
| 3,314,503 | 10/1967 | Neubert | 181/207 |
| 4,018,049 | 4/1977 | Konishi | 60/322 |
| 4,261,170 | 4/1981 | Suzuki | 60/302 |
| 4,420,933 | 12/1983 | Kajitani | 60/302 |
| 4,869,064 | 9/1989 | Deutschmann | 60/322 |
| 4,962,826 | 10/1990 | House | 60/322 |

FOREIGN PATENT DOCUMENTS 3-83315 8/1991 Japan .

*Primary Examiner*—Ira S. Lazarus
*Assistant Examiner*—Daniel J. O'Connor
*Attorney, Agent, or Firm*—Foley & Lardner

[57] ABSTRACT

A manifold converter comprises a housing constructed of two metal shells welded at their mating edges; a catalyzer carrier unit installed in the housing in a manner to define therein upstream and downstream portions with respect to the catalyzer carrier unit; and a sealing mat disposed between the catalyzer carrier unit and the housing to achieve a hermetical sealing therebetween. A binding structure is further employed for binding a given portion of the housing where the sealing mat is located. With this binding structure, undesired permanent expansion of the housing caused by the inevitable thermal expansion is suppressed or at least minimized.

22 Claims, 6 Drawing Sheets

MANIFOLD CONVERTER

BACKGROUND OF THE INVENTION

1. Field of the Invention

The present invention relates in general to catalytic converters installed in an exhaust system of an internal combustion engine, and more particularly, to catalytic converts of a type called "manifold converter" which is directly connected to output ports of an exhaust manifold of the internal combustion engine.

2. Description of the Prior Art

In order to clarify the task of the present invention, a conventional manifold converter will be described with reference to FIGS. 6 to 8, which is shown in Japanese Utility Model First Provisional Publication 3-83315.

In FIGS. 6 to 8, there is shown the conventional manifold converter which is generally designated by numeral 1. As is seen from FIGS. 7 and 8, the manifold converter 1 is connected to outlet pipes 5*a*, 5*b*, 5*c* and 5*d* of an exhaust manifold 5 which is mounted to one side of an internal combustion engine 3. As is seen from FIG. 7, the manifold converter 1 is vertically held by the exhaust manifold 5 and has an output port from which an exhaust pipe 19 extends toward a muffler (not shown).

As is seen from FIGS. 7 and 8, the manifold converter 1 comprises a housing 9 having an oval cross section. The housing 9 is constructed of two metal shells 9*a* and 9*b* which are assembled to constitute a vessel structure. Within an enlarged container part 11 (see FIG. 8) of the housing 9, there is tightly installed a catalyser carrier unit 7 which has an oval cross section. The housing 9 has respective diffusers 13 and 15 at upstream and downstream portions thereof with respect to the catalyser carrier unit 7. The upstream diffuser 13 has gas inlet ports 13*a* connected with the outlet pipes 5*a*, 5*b*, 5*c* and 5*d* of the exhaust manifold 5, while the downstream diffuser 15 has a gas outlet port 15*a* connected with the exhaust pipe 19. The gas outlet port 15*a* is formed with a flange 17.

Along upper and lower peripheral edges of the catalyser carrier unit 7, there extend respective shock absorbing members 21 and 23 which are pressed against diametrically reduced upper and lower portions of the container part 11. Thus, the catalyser carrier unit 7 is held in the container part 11 through the shock absorbing members 21 and 23.

Furthermore, between the catalyser carrier unit 7 and the container part 11, there are installed corrugated support members 25*a* and 25*b* and a foamed sealing mat 27. Due to provision of the sealing mat 27, the clearance between the catalyser carrier unit 7 and the container part 11 is hermetically sealed, so that gas fed to the upstream diffuser 13 is forced to travel through only the catalyser carrier unit 7.

As is seen from FIGS. 6 and 7, a shroud 29 is fixed to the housing 9 at an outer side thereof which is remote from the engine 3. Although not shown in the drawings, a plurality of bosses are integrally formed on the housing 9 to define a certain air clearance between the shroud 29 and the outer surface of the housing 9.

Under operation of the engine 3, exhaust gas from the engine 3 is led into the exhaust manifold 5 and then led into the manifold converter 1. The gas fed to the converter 1 is purified by the catalyser on the carrier unit 7 and then led to the exhaust pipe 19.

However, due to its inherent construction, the above-mentioned conventional manifold converter 1 has the following drawbacks.

That is, during operation of the engine 3, the housing 9 of the manifold converter 1 is subjected to heat expansion due to the marked heat generated in the converter 1. While, when the engine is at a standstill, the housing 9 of the converter 1 is cooled and thus contracts. Thus, long use of the converter 1 while being attacked by such expansion and contraction tends to cause the container part 11 of the housing 9 to have a permanent expansion which brings about a clearance between the foamed sealing mat 27 and the container part 11. The clearance thus produced constitutes an undesired bypass passage for the gas in the converter 1. Furthermore, such clearance lowers the stability with which the foamed sealing mat 27 is seated in the right position. In fact, in severe cases, due to marked gas pressure applied to such unstable sealing mat 27, the mat 27 is scattered in the gas.

SUMMARY OF THE INVENTION

It is therefore an object of the present invention to provide a manifold converter which is free of the above-mentioned drawbacks.

According to the present invention, there is provided a manifold converter for use with an exhaust manifold of an internal combustion engine. The manifold converter comprises a housing constructed of two metal shells welded at their mating edges; a catalyser carrier unit installed in the housing in a manner to define therein upstream and downstream portions with respect to the catalyser carrier unit; a sealing mat disposed between the catalyser carrier unit and the housing to achieve a hermetical sealing therebetween; and a binding structure binding a given portion of the housing in a manner to obstruct expansion of the housing, the given portion being the portion where the sealing mat is located.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
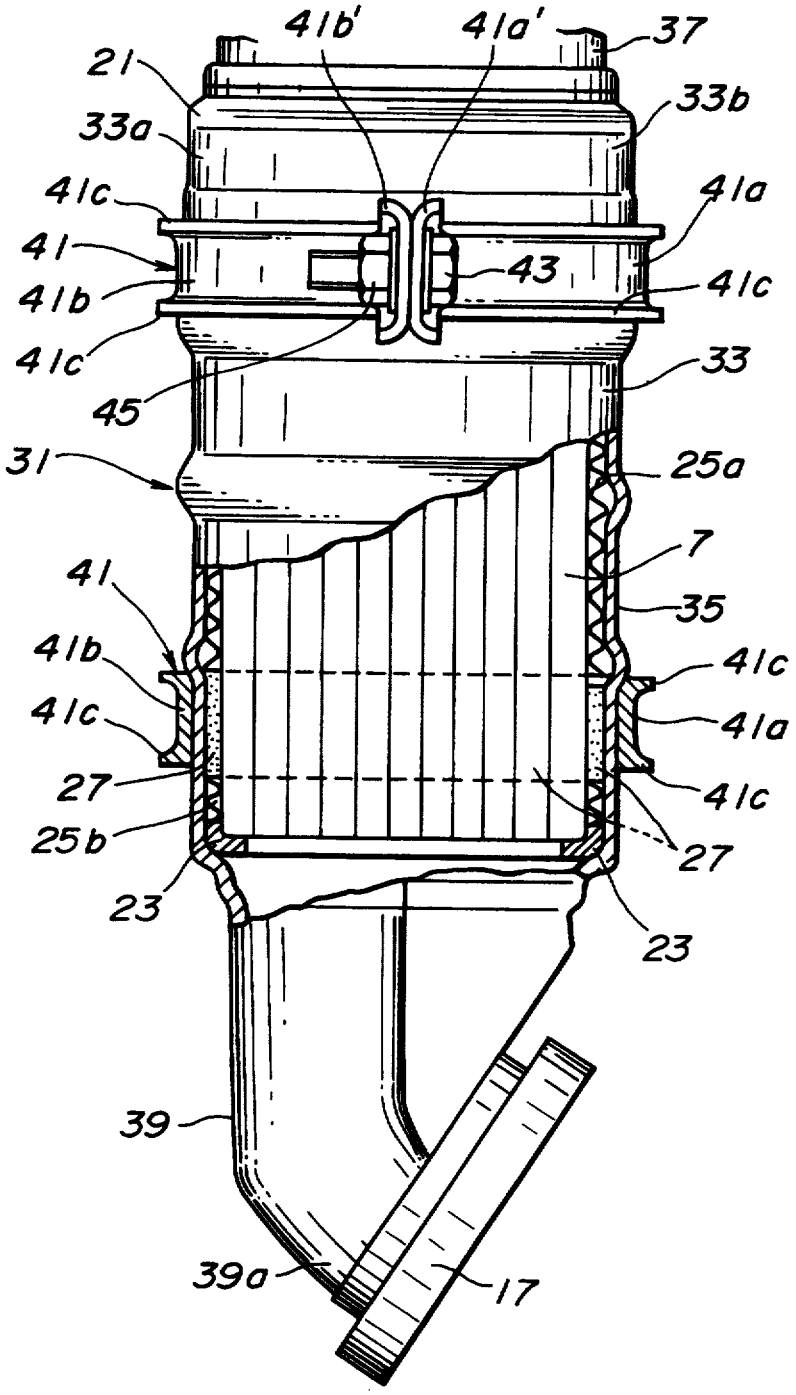
FIG. 1 is a partially sectioned side view of an essential portion of a manifold converter which is a first embodiment of the present invention.
Figure 2:
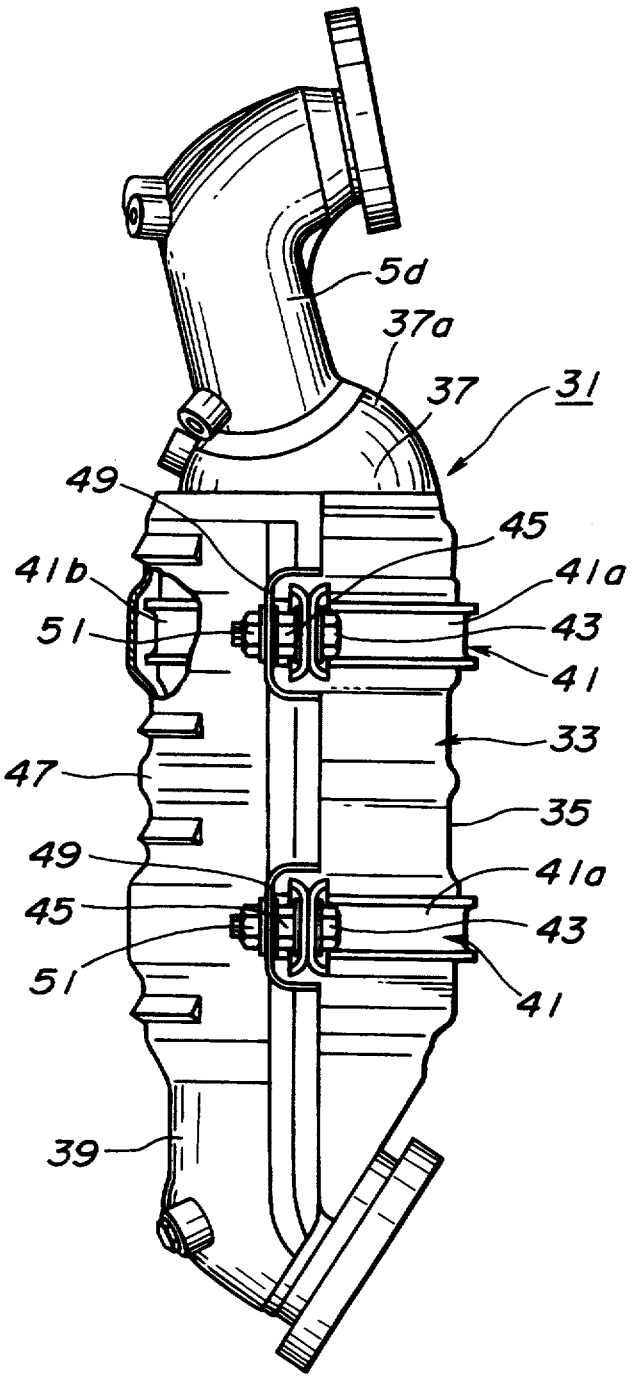
FIG. 2 is a side view of the manifold converter of the first embodiment.
Figure 3:
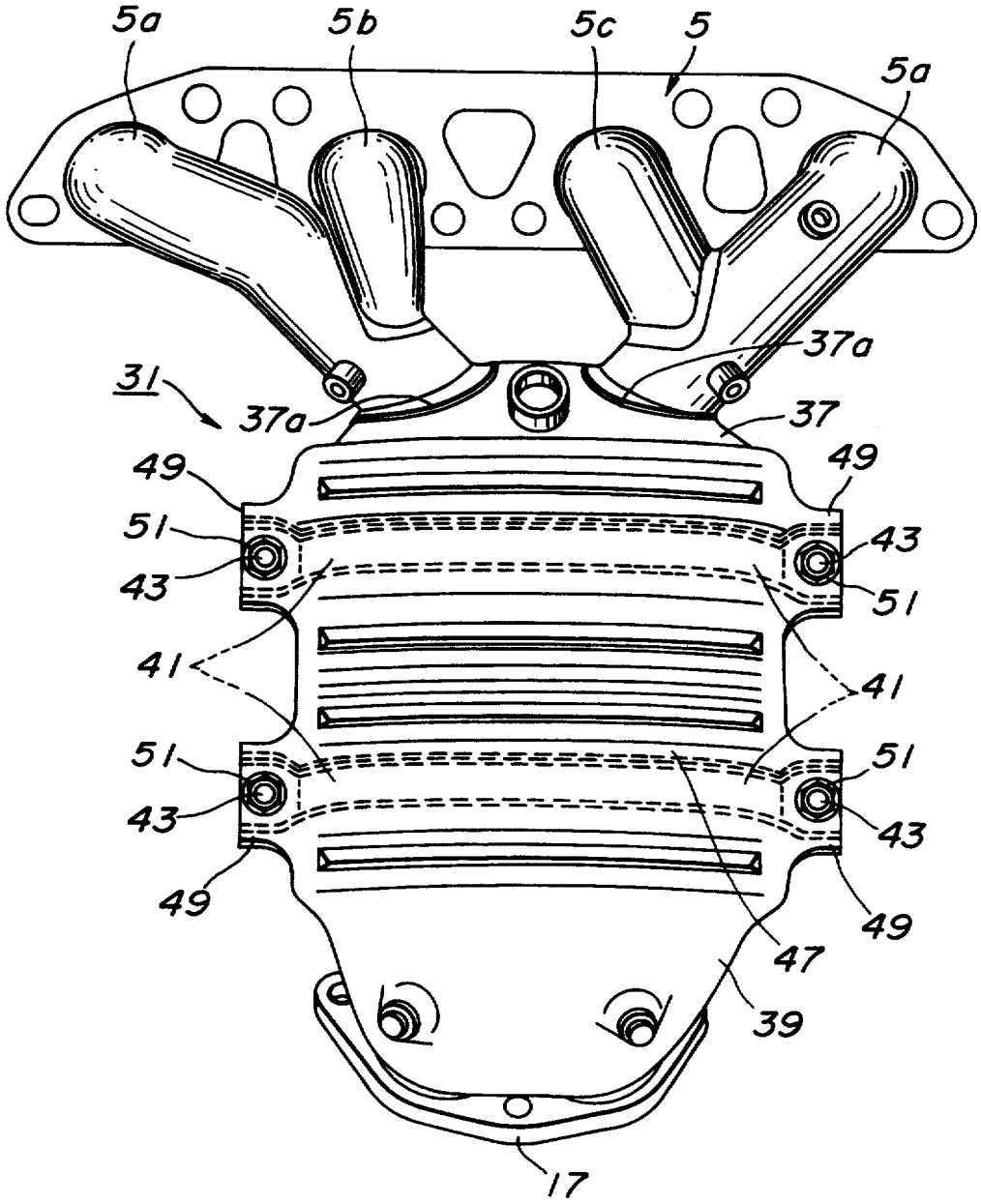
FIG. 3 is a front view of the manifold converter of the first embodiment.

Referring to FIGS. 1 to 3, there is shown a manifold converter 31 which is a first embodiment of the present invention.

In the following description, parts and constructions which are substantially the same as those in the aforementioned conventional manifold converter 1 will be denoted by the same numerals and detailed explanation of them will be omitted for facilitation of description.

In FIG. 1, there is shown a partially sectioned side view of the manifold converter 31. Similar to the aforementioned manifold converter 1, the converter 31 of the present invention is vertically held by an associated internal combustion engine (not shown).

As is best seen from FIG. 1, the manifold converter 31 of the first embodiment comprises a housing 33 which has an oval cross section. The housing 33 is constructed of two metal shells 33*a* and 33b which are assembled to constitute a vessel structure. More specifically, the two shells 33*a* and 33*b* are welded at their mating edges to constitute a robust housing.

Within an enlarged container part 35 of the housing 33, there is tightly installed a catalyser carrier unit 7 which has an oval cross section. The housing 33 has respective diffusers 37 and 39 at upstream and downstream portions thereof with respect to the catalyser carrier unit 7.

As is seen from FIG. 3, the upstream diffuser 37 has gas inlet ports 37*a* connected with outlet pipes 5*a*, 5*b*, 5*c* and 5*d* of an exhaust manifold 5 which is mounted to one side of the associated internal combustion engine (not shown). While, the downstream diffuser 39 has a gas outlet port 39*a* connected with an exhaust pipe (not shown). The gas outlet port 39*a* is formed with a flange 17.

As is shown in FIG. 1, along upper and lower peripheral edges of the catalyser carrier unit 7, there extend respective shock absorbing members 21 and 23 which are pressed against diametrically reduced upper and lower portions of the container part 35. Thus, the catalyser carrier unit 7 is held in the container part 35 through the shock absorbing members 21 and 23.

Furthermore, between the catalyser carrier unit 7 and the container part 35, there are installed corrugated support members 25*a* and 25*b* and a foamed sealing mat 27. As shown, the foamed sealing mat 27 is positioned at a lower part of the catalyser carrier unit 7. Preferably, the foamed sealing mat 27 is constructed of "INTERLUM MAT" (trade name) supplied by SUMITOMO 3M Co. Ltd. Due to provision of the sealing mat 27, the clearance between the catalyser carrier unit 7 and the container part 35 is hermetically sealed, so that gas fed to the upstream diffuser 37 is forced to travel through only the catalyser carrier unit 7.

As is shown in FIGS. 2 and 3, by means of an aftermentioned structure, a shroud 47 is mounted to an outer side of the housing 33, which side is remote from the engine.

In the first embodiment, the following measure is employed for eliminating the above-mentioned drawbacks of the conventional converter 1.

That is, two binding structures 41 are employed for binding the container part 35 of the housing 33. With these binding structures 41, the thermal expansion of the container part 35 is suppressed or at least minimized, and thus the undesired by-pass clearance is prevented from appearing between the catalyser carrier unit 7 and the housing 33.

As is seen from FIG. 1, the two binding structures 41 are respectively put around axially spaced portions of the container part 35, one being around an upper portion of the container part 35 and the other being around a lower portion of the same. As shown, the lower binding structure 41 is put around the container part 35 at the position where the foamed sealing mat 27 is located.

As is seen from FIGS. 1 and 3, each binding structure 41 comprises two longitudinally aligned arcuate metal bands 41*a* and 41*b* which are respectively put on the shells 33*b* and 33*a* of the housing 33. If desired, the metal bands 41*a* and 41*b* may be welded to the shells 33*b* and 33*a*. As shown in the drawings, each metal band 41*a* or 41*b* has a generally U-shaped cross section. That is, the metal band 41*a* or 41*b* has side flanges 41*c* for increasing the mechanical strength thereof.

For connecting the two metal bands 41*a* and 41*b*, two connector units are used, each including a bolt 43 and a nut 45. That is, one ends of the two metal bands 41*a* and 41*b* are connected through one connector unit, and the other ends of the two metal bands 41*a* and 41*b* are connected through the other connector unit.

More specifically, as is understood from FIG. 1, mated end portions of the two metal bands 41*a* and 41*b* are raised to constitute respective flanges 41*a*' and 41*b*'. These flanges 41*a*' and 41*b*' are formed with aligned openings through which the bolt 43 passes to engage with the nut 45. If desired, the nut 45 may be welded to the flange 41*b*'.

As is understood from FIGS. 2 and 3, by using the bolts 43, the shroud 47 is mounted to the housing 33. That is, as is best shown in FIG. 3, the shroud 47 is formed at its four connecting flanges 49 with respective openings through which the four bolts 43 of the connector units pass. Four additional nuts 51 are engaged with the bolts 43 to secure the shroud 47 to the binding structures 41.

Under operation of the engine, exhaust gas from the engine is led into the exhaust manifold 5 and then led into the manifold converter 31. The gas fed to the converter 31 is purified by the catalyser on the carrier unit 7 and then led to exhaust pipe.

During operation of the engine, the housing 33 of the manifold converter 31 is subjected to heat expansion due to the marked heat generated in the converter 31. However, in the present invention, due to provision of the two binding structures 41 having the above-mentioned construction, the thermal expansion of the container part 35 is suppressed or at least minimized, and thus, undesired permanent expansion of the container part 35 is prevented. Thus, the foamed sealing mat 27 can exhibit its normal sealing function for a long time, and formation of the undesired bypass passage in the converter 31 is suppressed.

Figure 4:
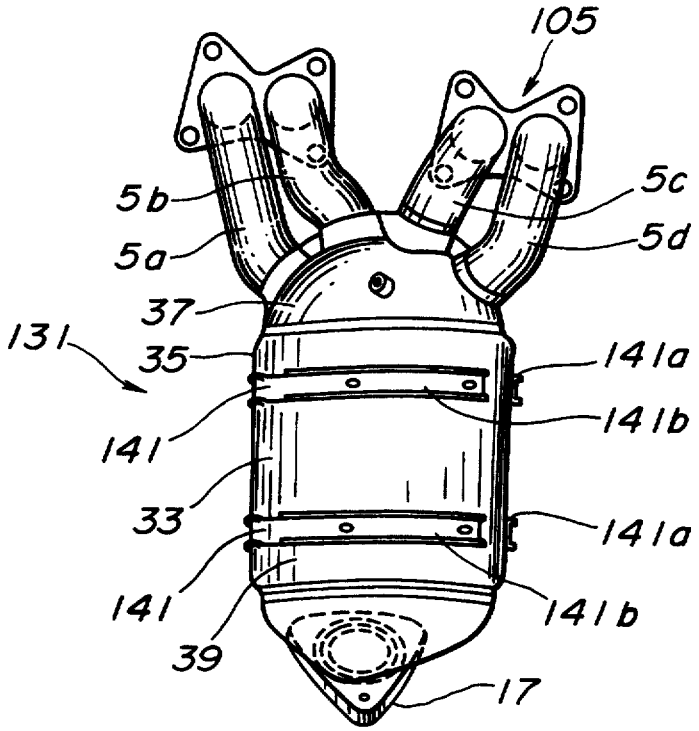
FIG. 4 is a front view of a manifold converter which is a second embodiment of the present invention.
Figure 5:
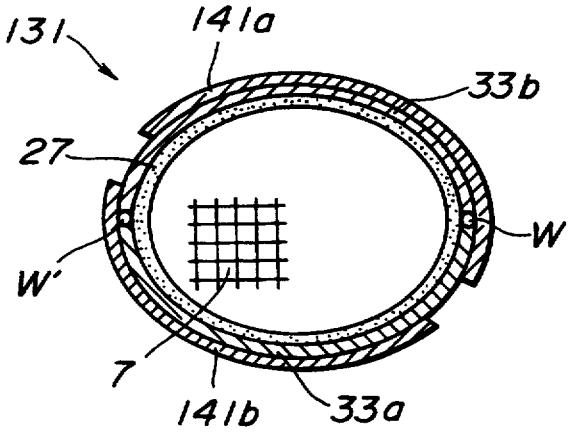
FIG. 5 is a sectional view of the manifold converter of the second embodiment.
Figure 6:
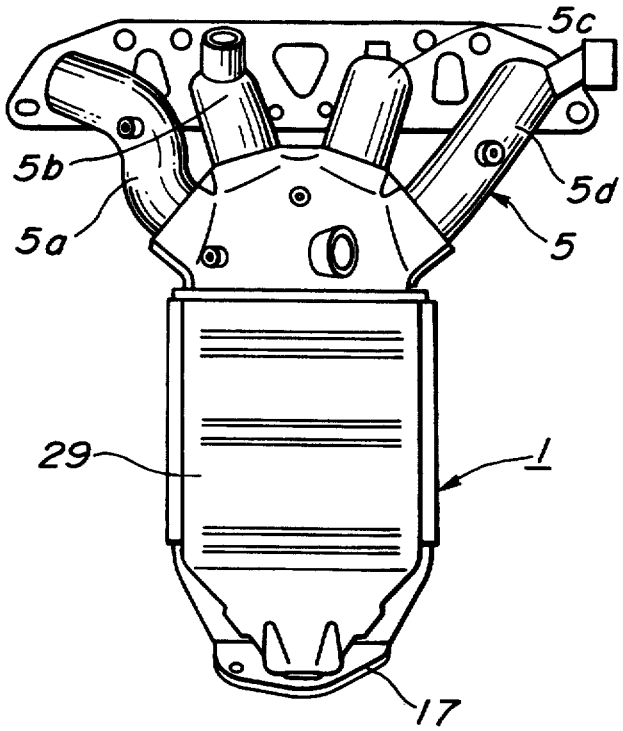
FIG.6 (PRIOR ART)
FIG. 6 is a front view of a conventional manifold converter.
Figure 7:
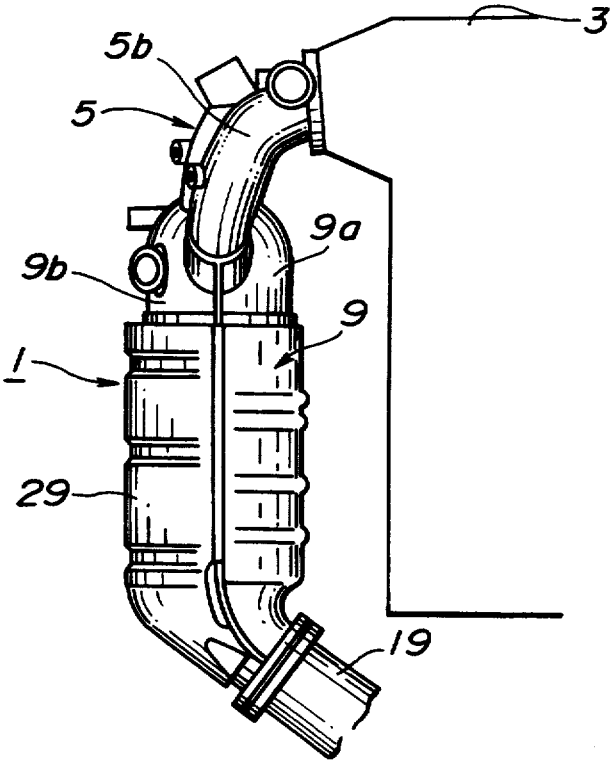
FIG.7 (PRIOR ART)
FIG. 7 is a side view of the conventional manifold converter.
Figure 8:
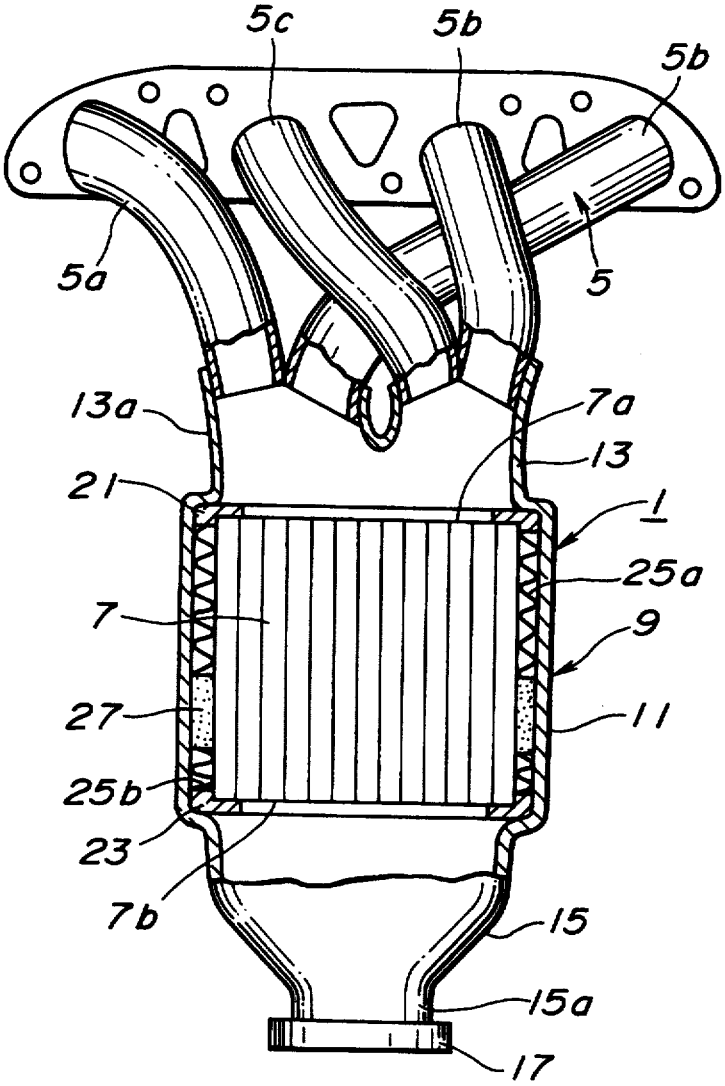
FIG.8 (PRIOR ART)
FIG. 8 is a partially sectioned front view of the conventional manifold converter.

Referring to FIGS. 4 and 5, there is shown a manifold converter 131 which is a second embodiment of the present invention.

Parts and constructions which are substantially the same as those in the aforementioned first embodiment are denoted by the same numerals, and detailed explanation of them will be omitted from the following for facilitation of description.

As is seen from FIG. 4, an exhaust manifold 105 with which the manifold converter 131 of the second embodiment is incorporated is of a split type.

As is seen from the drawings, the manifold converter 131 of the second embodiment comprises a housing 33 which is constructed of two metal shells 33*a* and 33*b*. As shown in FIG. 5, the two shells 33*a* and 33*b* are welded at their mating edges "W" and "W'" to constitute a robust housing. Within a container part 35 of the housing 33, there is installed a catalyser carrier unit 7 in the same manner as in the first embodiment. Designated by numeral 27 is the foamed sealing mat which is interposed between the catalyser carrier unit 7 and the container part 35 of the housing 33.

In the second embodiment, the following measure is employed for suppressing or at least minimizing the thermal expansion of the container part 35 of the housing 33.

Two binding structures 141 are employed for binding the container part 35 of the housing 33.

As shown in FIG. 4, the two binding structures 141 are respectively put around axially spaced portions of the container part 35, one being put around an upper portion of the container mart 35, and the other being put around a lower portion of the same. Preferably, the lower binding structure 141 is put on the container part 35 at the position where the foamed sealing mat 27 is located.

As is understood from the drawings, each binding structure 141 comprises two longitudinally aligned arcuate metal bands 141*a* and 141*b* which are secured, through welding or the like, to the convex outer surface of the container part 35. As is best shown in FIG. 5, the paired arcuate metal bands 141*a* and 141*b* are spaced from each other.

lit is to be noted that each arcuate metal band 141*a* or 141*b* has a longer portion which almost covers a major portion of one shell 33*a* or 33*b* and a shorter portion which covers one of the welded mating edges W and W' of the two shells 33*a* and 33*b*.

Under operation of the engine, the housing 33 of the manifold converter 131 is subjected to heat expansion. However, due to provision of the two binding structures 141 having the above-mentioned construction, the thermal expansion of the container part 35 is suppressed or at least minimized. Because the gently curved wall of the container part 35, which exhibits a larger thermal expansion, is provided with the longer portions of the metal bands 141*a* and 141*b*, the thermal expansion of the container part 35 is effectively suppressed.

Although, in the second embodiment of FIGS. 4 and 5, the two arcuate metal bands 141*a* and 141*b* of each binding structure 141 are arranged offset with respect to the housing 33 as is described hereinabove, they may be arranged symmetric with respect to an imaginary plane which includes the welded mating edges W and W' of the two shells 33*a* and 33*b*. In this modification, easier assembly is expected.

What is claimed is:

1. A manifold converter for use with an exhaust manifold of an internal combustion engine, comprising:

a housing constructed of two metal shells welded at their mating edges, said housing having gas inlet and outlet ports at longitudinally opposed portions;

a catalyser carrier unit installed in said housing in a manner to define a longitudinally extending clearance therebetween, said clearance surrounding said catalyser carrier unit;

a foamed sealing mat intimately disposed in said given space so that a hermetical sealing is achieved between said catalyser carrier unit and said housing; and a binding structure binding a given portion of said housing in a manner to prevent a thermal expansion of said housing, said given portion being the portion where said sealing mat is located.

2. A manifold converter as claimed in claim 1, in which said binding structure comprises:

two metal bands which are longitudinally aligned to bind said given portion of the housing; and holding means for tightly holding said two metal bands at said given portion.

3. A manifold converter as claimed in claim 2, in which said holding means comprises:

a first connector unit including a bolt and a nut, said first connector unit connecting one ends of said two metal bands; and a second connector unit including a bolt and a nut, said second connector unit connecting the other ends of said two metal bands.

4. A manifold converter as claimed in claim 3, in which the mated end portions of said two metal bands are raised to constitute respective flanges, said flanges being formed with aligned openings through which the bolt of the corresponding connector unit passes to engage with the corresponding nut.

5. A manifold convertor as claimed in claim 4, in which each of said metal bands is welded to the corresponding metal shell.

6. A manifold converter as claimed in claim 4, in which each of said metal bands has a generally U-shaped cross section.

7. A manifold converter as claimed in claim 4, in which each of said metal bands is welded to the corresponding metal shell.

8. A manifold converter as claimed in claim 2, further comprising:

another binding structure binding another portion of said housing in a manner to prevent a thermal expansion of salt housing.

9. A manifold converter as claimed in claim 8, in which the two binding structures are substantially the same in construction.

10. A manifold converter as claimed in claim 2, in which said holding means is a welding achieved for securing said two metal bands to the outer surface of said housing.

11. A manifold converter as claimed in claim 10, in which said two metal bands are separated from each other.

12. A manifold converter as claimed in claim 11, in which each metal band includes:

a longer portion which almost covers a major portion of one metal shell; and a shorter portion which covers one of the welded mating edges of the two metal shells.

13. A manifold converter as claimed in claim 11, in which said two metal bands are arranged symmetric with respect to an imaginary plane which includes the welded mating edges of said two metal shells.

14. A manifold converter for use with an exhaust manifold of an internal combustion engine, comprising:

a housing constructed of two metal shells welded at their mating edges;

a catalyser carrier unit installed in said housing in a manner to define therein upstream and downstream portions with respect to said catalyzer carrier unit;

a sealing mat disposed between said catalyser carrier unit and said housing to achieve a hermetical sealing therebetween;

two metal bands aligned about said housing to bind said given portion of said housing, each metal band having at both ends thereof raised flanges which are formed with openings, one flange of one metal band being mated with one flange of the other metal band;

two sets of bolts and nuts, each set being incorporated with the mated flanges of the two metal bands for tightly holding the metal bands at said given portion of said housing; and a shroud arranged to cover one side surface of said housing, said shroud being connected to said housing by means of said two sets of bolts and nuts.

15. A manifold converter as claimed in claim 14, in which said shroud is formed with flanges each being formed with an aperture, said shroud being connected to said housing having the bolts of said first and second connector units inserted through the openings of said flanges and engaged with the nuts of said first and second connector units.

16. A manifold converter for use with an exhaust manifold of an internal combustion engine, comprising:

a housing constructed of two metal shells welded at their mating edges, said housing having gas inlet and outlet ports at longitudinally opposed portions;

a catalyser carrier unit received in said housing in such a manner as to define a longitudinally extending clearance therebetween, said clearance surrounding said catalyser carrier unit;

first and second corrugated support members disposed in said clearance and arranged to leave a given space therebetween;

a foamed sealing mat intimately disposed in said given space so that a hermetical sealing is achieved between said catalyser carrier unit and said housing; and a binding structure binding a given portion of said housing in a manner to prevent a thermal expansion of said housing, said given portion being the portion where said sealing mat is located.

17. A manifold converter as claimed in claim 16, in which said binding structure comprises:

two metal bands which are longitudinally aligned to bind said given portion of the housing; and holding means for tightly holding said two metal bands at said given portion.

18. A manifold converter as claimed in claim 17, in which said holding means comprises:

a first connector unit including a bolt and a nut, said first connector unit connecting one end of said two metal bands; and a second connector unit including a bolt and a nut, said second connector unit connecting the other end of said two metal bands.

19. A manifold converter as claimed in claim 18, in which the mated end portions of said two metal bands are raised to constitute respective flanges, said flanges being formed with aligned openings through which the bolt of the corresponding connector unit passes to engage with the corresponding nut.

20. A manifold converter as claimed in claim 19, further comprising a shroud which is arranged to cover one side surface of said housing, said shroud being connected to said housing by means of said first and second connector units.

21. A manifold converter as claimed in claim 20, in which said shroud is formed with flanges each being formed with an aperture, said shroud being connected to said housing having the bolts of said first and second connector units inserted through the openings of said flanges and engaged with the nuts of said first and second connector units.

22. A manifold convertor as claimed in claim 19, in which each of said metal bands has a generally U-shaped cross section.

* * * * *